US006917273B2

(12) United States Patent
Okamoto

(10) Patent No.: US 6,917,273 B2
(45) Date of Patent: Jul. 12, 2005

(54) COMMON MODE CHOKE COIL WITH EDGEWISE WINDINGS AND LINE FILTER INCLUDING SAME

(75) Inventor: Toshinori Okamoto, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/665,567

(22) Filed: Sep. 22, 2003

(65) Prior Publication Data

US 2004/0100347 A1 May 27, 2004

(30) Foreign Application Priority Data

Oct. 15, 2002 (JP) ..... 2002-300371

(51) Int. Cl.[7] ..... H01F 5/00
(52) U.S. Cl. ..... 336/200
(58) Field of Search ..... 336/83, 200, 212, 336/232–234; 252/62.59–64

(56) References Cited

U.S. PATENT DOCUMENTS 4,342,013 A * 7/1982 Kallman ..... 333/181
6,436,308 B2 * 8/2002 Kobayashi et al. ..... 252/62.62
6,468,441 B1 * 10/2002 Kobayashi et al. ..... 252/62.56
6,767,478 B2 * 7/2004 Ito et al. ..... 252/62.62
2001/0025944 A1 * 10/2001 Kobayashi et al. ..... 252/62.62

FOREIGN PATENT DOCUMENTS

EP 1 134 202 A1 * 9/2001
EP 1 209 136 A1 * 5/2002

* cited by examiner

*Primary Examiner*—Tuyen T Nguyen
(74) *Attorney, Agent, or Firm*—Oliff & Berridge, PLC

(57) ABSTRACT

A common mode choke coil comprises: a Mn—Zn ferrite core which is shaped square, forms a closed magnetic path, and which has an initial permeability of at least 3,000 at 100 kHz and at least 100 at 10 MHz, respectively, at room temperature; and first and second edgewise windings which are formed respectively of first and second rectangular insulated wires. The first edgewise winding is provided around a core leg of the Mn—Zn ferrite core, and the second edgewise winding is provided around a core leg of the Mn—Zn ferrite core located oppositely to the core leg having the first edgewise winding provided therearound. This structure enables the core characteristics to be fully utilized without an influence of stray capacity of winding.

9 Claims, 8 Drawing Sheets

COMMON MODE CHOKE COIL WITH EDGEWISE WINDINGS AND LINE FILTER INCLUDING SAME

BACKGROUND OF THE INVENTION

1. Field of the Invention

The present invention relates to a common mode choke coil and a line filter used in various electronic circuits, and more particularly to a common mode choke coil and a line filter having edgewise windings of a rectangular insulated wire.

2. Description of the Related Art

In recent years, since the miniaturization and enhanced performance of an electronic apparatus have been strongly demanded, a common mode choke coil used in a line filter is required to be downsized and improved in performance. Meanwhile, the characteristic of a common mode choke coil, for example, conductive noise level is controlled by regulation in a frequency band between 150 kHz and 30 MHz. Conventionally, a common mode choke coil uses a round insulated wire (refer to FIG. 1 of Japanese Patent Publication No. 2000-150243). Such a conventional common mode choke coil, as shown in FIG. 4, comprises: a bobbin 413 shaped cylindrical with a cylindrical hollow, and having first and second windings 411 and 412 wound therearound; a closed magnetic path core 414 (hereinafter referred to simply as "magnetic core" as appropriate) of square type with its center core leg inserted in the hollow of the bobbin 413; a terminal stand 415 having the bobbin 413 and the magnetic core 414 mounted thereon; and four terminal pins 416 (only two are shown in the figure) having their one ends embedded in the terminal stand 415 and also connected to respective lead wires of the first and second windings 411 and 412.

The bobbin 413 is composed of two parts each shaped semi-cylindrical and put together with each other so as to enclose the center core leg of the magnetic core 414. The bobbin 413 has a partition 417, by which the first and second windings 411 and 412 wound around the bobbin 413 are separated from each other. The terminal stand 415 includes a frame section 418 having an opening and a base section 419 having the terminal pins 416 embedded therein. The frame section 418 is arranged to stand at an end portion of the base section 419 thereby forming a substantially L-letter in its side view. The magnetic core 414 is brought into contact with an outer peripheral part of the frame section 418 of the terminal stand 415 and a portion of the bobbin 413 is inserted in the opening of the frame section 418 so that the magnetic core 414 and the bobbin 413 are positioned securely and correctly. Also, insulation plates 420 are provided entirely at upper and lower ends of the frame section 418, respectively, so as to go through respective gaps between the both outer core legs of the magnetic core 414 and the bobbin 413 thereby insulating the magnetic core 414 from the first and second windings 411 and 412 wound on the bobbin 413.

On the other hand, a common mode choke coil using edgewise windings of a rectangular insulated wire is increasingly used because the edgewise winding has the following advantages over the winding of a round insulated wire. Firstly, the edgewise winding can better achieve higher performance, higher efficiency, miniaturization and lower-profile due to its larger conductor occupation ratio. Secondly, the edgewise winding has a smaller stray capacity and therefore can realize better frequency characteristics.

And thirdly, the edgewise winding does not require a process of winding a wire on a bobbin, and is easier to assemble, resulting in an easier automation of the manufacturing process.

FIGS. 5A and 5B show a conventional common mode choke coil using edgewise windings, perspectively viewed from two opposing directions, respectively (refer to FIG. 1 of Japanese Patent Publication No. H09-134827). The common mode choke coil comprises two edgewise windings 59 each formed of a rectangular insulated wire, each provided around a core leg 54*a* of a magnetic core 54 consisting of two core pieces, and having the same number of winding turns, with one winding 59 of the two being stacked on the other winding 510 concentrically. The one winding 59 has two terminations 59*a* and 59*b*, which lead out without crossing each other at one side of a bobbin 57, have their insulation peeled off, and which are hooked respectively around termination tying sections 57*e* and 57*f* of the bobbin 57 thereby constituting terminals. And, the other winding 510 has two terminations 510*a* and 510*b*, which lead out crossing each other at a side of the bobbin 57 opposite to the aforementioned one side, have their insulation peeled off, and which are hooked respectively around termination tying sections 57*g* and 57*h* of the bobbin 57 thereby constituting terminals.

FIG. 6 shows another conventional common mode choke coil using edgewise windings (refer to FIG. 2 of Japanese Patent Publication No. H11-273975). The common mode choke coil comprises: a magnetic core 617 consisting of two core pieces, shaped square and forming a closed magnetic path; and four edgewise windings, i.e., first to fourth windings 611, 612, 613 and 614 provided around the magnetic core 617. The first and second windings 611 and 612 are provided respectively around two core legs 617*a* butting each other, and the third and fourth windings are provided respectively around the other two core legs 617*a* butting each other. The first and third windings are connected in series to each other, and the second and fourth windings are connected in series to each other. Magnetic fluxes generated respectively by the first and second windings cancel out each other with a line current, which is the case also with magnetic fluxes of the second and third windings, the third and fourth windings, and the fourth and first windings. On the other hand, magnetic fluxes generated respectively by the first and third windings are aggregated with a line current, and also magnetic fluxes generated respectively by the second and fourth windings are aggregated by a line current. And, the first and fourth windings are arranged side by side with their winding directions set opposite to each other, and the second and third windings are arranged side by side with their winding directions set opposite to each other so that magnetic fluxes generated by the first to fourth windings are aggregated with currents flowing in the same direction (noise current).

A line filter using one of the above-described various common mode choke coils is shown in FIG. 7, which comprises a common mode choke coil 70 and by-pass capacitors 71 such that one termination of the common mode choke coil 70 serves as an input terminal and the other termination thereof is connected to the by-pass capacitors 71 thereby serving as an output terminal, and a load 72 is connected to both ends of the output terminal, whereby conductive noise in the frequency band mentioned above is removed. In the line filter structured as described above, noise is cut mostly such that noise current in a low frequency is cut by impedance due to an inductance factor of the common mode choke coil 70, deterioration of inductance performance in a high frequency band is made up for by the by-pass capacitors 71, and that a high frequency noise current is caused to flow toward the ground.

Another line filter using two of the above-described various common mode choke coils is shown in FIG. 8, which comprises two common mode choke coils 70 and 80 and by-pass capacitors 71 such that the common mode choke coils 70 and 80 are connected in cascade to each other, the by-pass capacitors 71 are connected to the connections between the common mode choke coils 70 and 80, one termination of the common mode choke coil 70 serves as an input terminal, and that one termination of the common mode choke coil 80 serves as an output terminal, whereby the performance of the filter is improved. Thus, the line filter comprises one or more common mode choke coils and by-pass capacitors in order to remove conductive noise in the above-described frequency band.

The performance of the above-described common mode choke coils will hereinafter be explained with reference to an equivalent circuit shown in FIG. 9, in which L represents inductance, Cs represents stray capacity, and R represents wire resistance.

The following equation (1) is valid:

$$Z=R+j\omega L/(1-\omega^2 LCs) \quad (1)$$

where Z is impedance between terminals c and d of the coil, f is frequency, and ω is resonant frequency and equal to 2πf.

Here, resonant frequency ω can be expressed by the following equation (2):

$$\omega=(LCs)^{-1/2} \quad (2)$$

The above equations can hold true only when L is constant relative to the frequency, but in practice, the initial permeability $\mu$ of the core varies according to the frequency as shown in FIG. 10, indicating a sharp decline in the high frequency band.

Referring to FIG. 10, S1 represents characteristics of a conventional Mn—Zn ferrite core, and S2 represents frequency characteristics of a new Mn—Zn ferrite core (refer to Japanese Patent Publication Nos. 2001-220221 and 2001-220222) used in the present invention and described later in detail. In the conventional Mn—Zn ferrite core, the initial permeability $\mu$ is as large as 5,000 in a low frequency band but declines sharply, for example, to approximately ⅓ at 1 MHz, as indicated by symbol A. On the other hand, in the new Mn—Zn ferrite core, the initial permeability $\mu$ is 4,000, somewhat smaller than that of the conventional Mn—Zn ferrite, in a low-frequency band but declines less sharply, as indicated by symbol B, only to approximately $1/2.5$ at 1 MHz, and keeps declining less sharply from 1 MHz upward than in the conventional Mn—Zn ferrite core.

For the ease of understanding problems associated with the conventional Mn—Zn ferrite core, changes of characteristics of Mn—Zn ferrite cores depending on difference in their initial permeability will hereinafter be explained with reference to FIGS. 10 and 11. FIG. 11 shows characteristics of three toroidal cores each having an outer diameter of 25 mm, an inner diameter of 15 mm and a thickness of 13 mm, and having about 20 winding turns of a round insulated wire therearound thus limiting the number of winding turns in order to prevent stray capacity Cs of winding from having influence thereby allowing the characteristics of the cores to distinctly show up. In FIG. 11, symbols Z1 and Z2 show frequency characteristics of impedance of common mode choke coils using the conventional Mn—Zn ferrite core (whose characteristics are shown by S1 in FIG. 10 ) and the new Mn—Zn ferrite core (whose characteristics are shown by S2 in FIG. 10), respectively. Specifically, the common mode choke coil having the characteristics shown by Z1 uses a core whose initial permeability $\mu$ declines sharply from 1 MHz upward, while the common mode choke coil having the characteristics shown by Z2 uses a core whose initial permeability $\mu$ measures 100 or more even at 10 MHz.

As apparent in FIG. 11, the impedance of the common mode choke coil (whose characteristics are shown by Z1), which uses the conventional Mn—Zn ferrite core whose initial permeability $\mu$ starts declining already at 1 MHz, comes down to as low as 1 kΩ at 35 MHz. On the other hand, the impedance of the common mode choke coil (whose characteristics are shown by Z2), which uses the new Mn—Zn ferrite core whose initial permeability $\mu$ measures at 100 or more even at 10 MHz, starts declining at 5 MHz or higher and maintains as high as 3 kΩ at 35 MHz. Thus, a core which has a high initial permeability in the high frequency band has a large impedance in the high frequency band. However, as the number of winding turns increases, the stray capacity Cs of winding becomes increased causing a resonance at a frequency gained by the aforementioned equation (2) before the initial permeability $\mu$ starts changing, and then the impedance Z decreases according to the characteristics defined by an interaction between the stray capacity Cs of winding and the inductance L. As a result, even in the core having a high initial permeability in the high frequency band, its impedance starts declining at a lower frequency due to the conventional round insulated wire having a large stray capacity Cs, and consequently its impedance curve tends to shift entirely to a lower frequency, thereby producing characteristics shown by symbol Z3 in FIG. 11.

The conventional common mode choke coil usually uses a Mn—Zn ferrite core whose initial permeability varies according to the frequency, measuring high in a low frequency band but declining sharply in a high frequency band as shown by S1 in FIG. 10. The conventional common mode choke coil may alternatively use a Ni—Zn ferrite core. In the Ni—Zn ferrite, the initial permeability does not decline sharply in a high frequency band but is low in a low frequency band.

In order to efficiently remove the conductive noise factor of the common mode choke coil, it is essential to make the impedance Z of the common mode choke coil as large as possible. The following three methods are available to increase the impedance Z when a wire is set to have a constant diameter in view of current capacity based on a temperature rise of the coil.

1. The initial permeability $\mu$ of the core is maximized;
2. The number of winding turns is increased; and
3. The core constant (=effective magnetic path length/effective section area) is reduced.

The above three methods, however, have respective problems described below.

1. The maximization of the initial permeability $\mu$ results in an increased impedance. However, the initial permeability $\mu$ has frequency characteristics as discussed above. In the conventional Mn—Zn ferrite core, as shown by S1 in FIG. 10, the initial permeability ranges around 5,000 in the low frequency band, specifically only up to 300 kHz or 500 kHz, and then declines sharply as indicated by symbol A to approximately ⅓ at 1 MHz. There is a ferrite core which has an initial permeability of 10,000 or higher, but the initial permeability starts declining at a still lower frequency, for example 100 kHz, and measures a still lower value in a high frequency band. On the other hand, the Ni—Zn ferrite core has a large impedance between 10 MHz and 30 MHz but has a low initial permeability in the low frequency band. Therefore, the number of winding turns must be increased to increase impedance, which limits its usage to special application.

In any case, the frequency band between 150 kHz and 30 MHz, in which conductive noise is regulated, cannot be successfully covered.

2. Inductance is proportional to a square of the number of winding turns. However, the increase in the number of turns causes stray capacity of winding to increase. Consequently, not only the resonant frequency becomes lower, but also the impedance in a high frequency band decreases. As a result, the impedance starts declining at a lower frequency due to the effect of the stray capacity Cs, which prohibits an excellent core material from fully demonstrating its excellence. And, the increased number of winding turns deteriorates heat radiation effect thus causing a temperature rise, which results in requirement of an increased diameter of the wire.

3. The shape of the core is determined by a space factor of a board and therefore cannot be freely determined.

Thus, the following problem exists in acquiring a common mode choke coil that works duly in a wide frequency band (between 10 kHz and 30 MHz). Since the conventional Mn—Zn ferrite core has a high initial permeability, its impedance can be increased without increasing the number of winding turns, thus preventing the increase of the stray capacity. However, the sharp decline of the initial permeability in the high frequency band causes the impedance to decrease. On the other hand, since a core having a high initial permeability in the high frequency band has a low initial permeability in the low frequency band, the number of winding turns must be increased in order to obtain a large impedance in the low frequency band. However, the increased number of winding turns causes the stray capacity to increase, thus resulting in a reduced impedance in the high frequency band.

Also, a line filter using common mode choke coils inherently incurs the above problem. Therefore, by-pass capacitors for removing noises in the high frequency band are required in the line filter. However, the provision of the by-pass capacitors encounters space and cost problems.

SUMMARY OF THE INVENTION

The present invention has been made in light of the above, and its object is to provide a common mode choke coil with an improved performance in a high frequency band and also a low cost line filter.

In order to achieve the above object, according to a first aspect of the present invention, a common mode choke coil comprises: a Mn—Zn ferrite core which is shaped square, forms a closed magnetic path, and which has an initial permeability of at least 3,000 at 100 kHz and at least 100 at 10 MHz at room temperature; and first and second edgewise windings which are formed respectively of first and second rectangular insulated wires. The first edgewise winding is provided around a core leg of the Mn—Zn ferrite core, and the second edgewise winding is provided around a core leg of the Mn—Zn ferrite core located oppositely to the core leg having the first edgewise winding provided therearound.

According to a second aspect of the present invention, in the common mode choke coil of the first aspect, the Mn—Zn ferrite core has a main component composition comprising 44.0 to 49.8 mol % $Fe_2O_3$, 15.0 to 26.5 mol % ZnO, 0.1 to 3.0 mol % CoO, 0.02 to 1.00 mol % $Mn_2O_3$ and the remainder consisting of MnO, and also has a subsidiary component composition comprising at least one of 0.010 to 0.200 mass % $V_2O_5$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass % $WO_3$.

According to a third aspect of the present invention, in the common mode choke coil of the first aspect, the Mn—Zn ferrite core has a main component composition comprising 44.0 to 49.8 mol % $Fe_2O_3$, 15.0 to 26.5 mol % ZnO, 0.02 to 1.00 mol % $Mn_2O_3$ and the remainder consisting of MnO, and also has a subsidiary component composition comprising at least one of 0.010 to 0.200 mass % $V_2O_5$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass % $WO_3$.

With the structure described above and use of the ferrite core composition described above, the common mode choke coil of the present invention enables excellent core characteristics to be fully utilized without influence of stray capacity of winding thereby achieving excellent frequency characteristics, which allows the noise control level to be cleared with an increased margin resulting in an improved yield rate of the product.

According to a fourth aspect of the present invention, a line filter comprises: a Mn—Zn ferrite core which is shaped square, forms a closed magnetic path, and which has an initial permeability of at least 3,000 at 100 kHz and at least 100 at 10 MHz at room temperature; and first and second edgewise windings which are formed respectively of first and second rectangular insulated wires. The first edgewise winding is provided around a core leg of the Mn—Zn ferrite core, and the second edgewise winding is provided around a core leg of the Mn—Zn ferrite core located oppositely to the core leg having the first edgewise winding provided therearound. And, one terminations of said first and second edgewise windings are input terminals, the other terminations of the first and second edgewise windings are output terminals, and the first and second windings are connected to each other such that respective magnetic fluxes generated by the first and second edgewise windings cancel out each other when a line current is applied to the input terminals.

With the structure described above, the line filter of the present invention can remove high frequency noise by the common mode choke coil alone, not requiring by-path capacitors, whereby the line filter can be used in the high frequency band realizing downsizing and cost reduction. If by-path capacitors are employed for further enhancing performance, their capacity can be minimized thus still favoring downsizing. Further, improvement of filter performance, which can be achieved conventionally by use of a plurality of common mode coke coils, can be improved by one common mode choke coil without suffering deterioration in high frequency characteristics, thereby reducing the number of components.

DETAILED DESCRIPTION OF THE PREFERRED EMBODIMENTS

A preferred embodiment of the present invention will hereinafter be explained with reference to FIG. 1.

Figure 1:
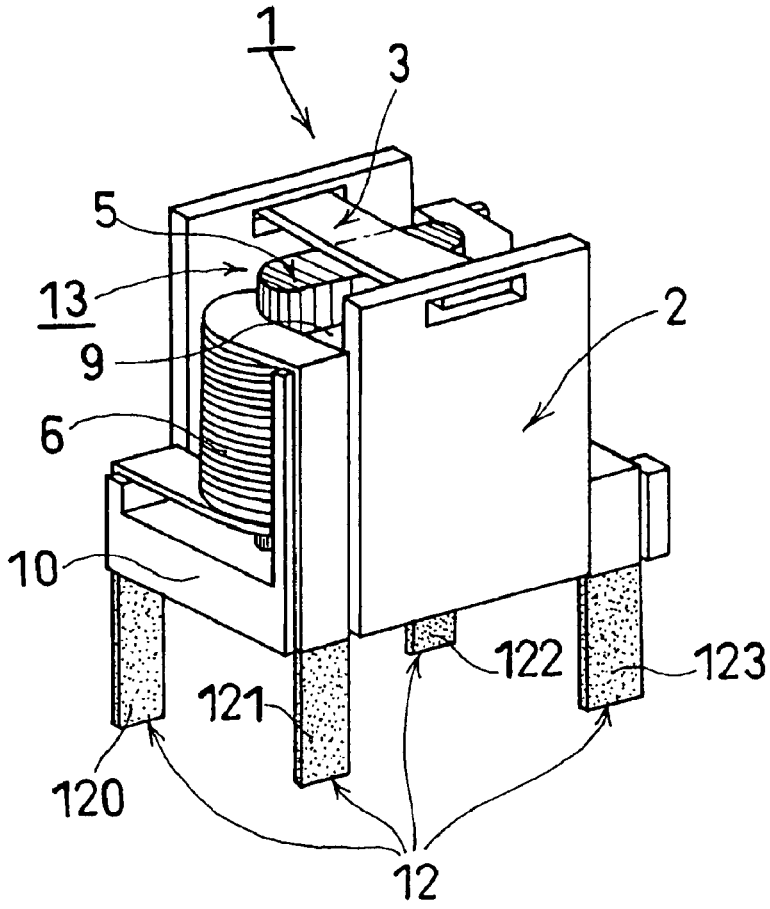
FIG. 1 shows a perspective view of a common mode choke coil according to an embodiment of the present invention.

Referring to FIG. 1, a common mode choke coil 1 generally comprises a holder 2 made of a plastic resin, a coil section 13 mounted on a holder base section 10 of the holder 2, and a core securing plate spring 3. The coil section 13 comprises two edgewise windings 6 (only one is seen in the figure) of a rectangular insulated wire, a substantially square magnetic core 5 consisting of two core pieces each including two core legs (blinded in the figure), and a bobbin 9 having the core legs of the magnetic core 5 inserted therein and fixedly attached onto the holder 2 by means of the core securing plate spring 3. The bobbin 9 has its axis oriented perpendicular to a mounting board (not shown in the figure). End portions (terminations) 12 of the edgewise windings 6 which have their insulation resin peeled off and are plated with solder are attached to the board (not shown) after the coil section 13 is attached to the holder 2.

The magnetic core 5 is of a new Mn—Zn ferrite core described below, which has a high initial permeability even in the high frequency band as discussed above. The new Mn—Zn ferrite core has an initial permeability of at least 3,000 at 100 kHz and at least 100 at 10 MHz, respectively, at room temperature. The new Mn—Zn ferrite core contains, as a main component composition, 44.0 to 49.8 mol % $Fe_2O_3$, 15.0 to 26.5 mol % ZnO, 0.1 to 3.0 mol % CoO, 0.02 to 1.00 mol % $Mn_2O_3$ and the remainder consisting of MnO, and also has a subsidiary component composition comprising at least one of 0.010 to 0.200 mass % $V_2O_6$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass % $WO_3$ (refer to Japanese Patent Publication No. 2001-220221).

Alternatively, the new Mn—Zn ferrite core may have a main component composition comprising 44.0 to 49.8 mol % $Fe_2O_3$, 15.0 to 26.5 mol % ZnO, 0.02 to 1.00 mol % $Mn_2O_3$ and the remainder consisting of MnO, and also a subsidiary component composition comprising at least one of 0.010 to 0.200 mass % $V_2O_5$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass % $WO_3$ (refer to Japanese Patent Publication No. 2001-220222).

Figure 2:
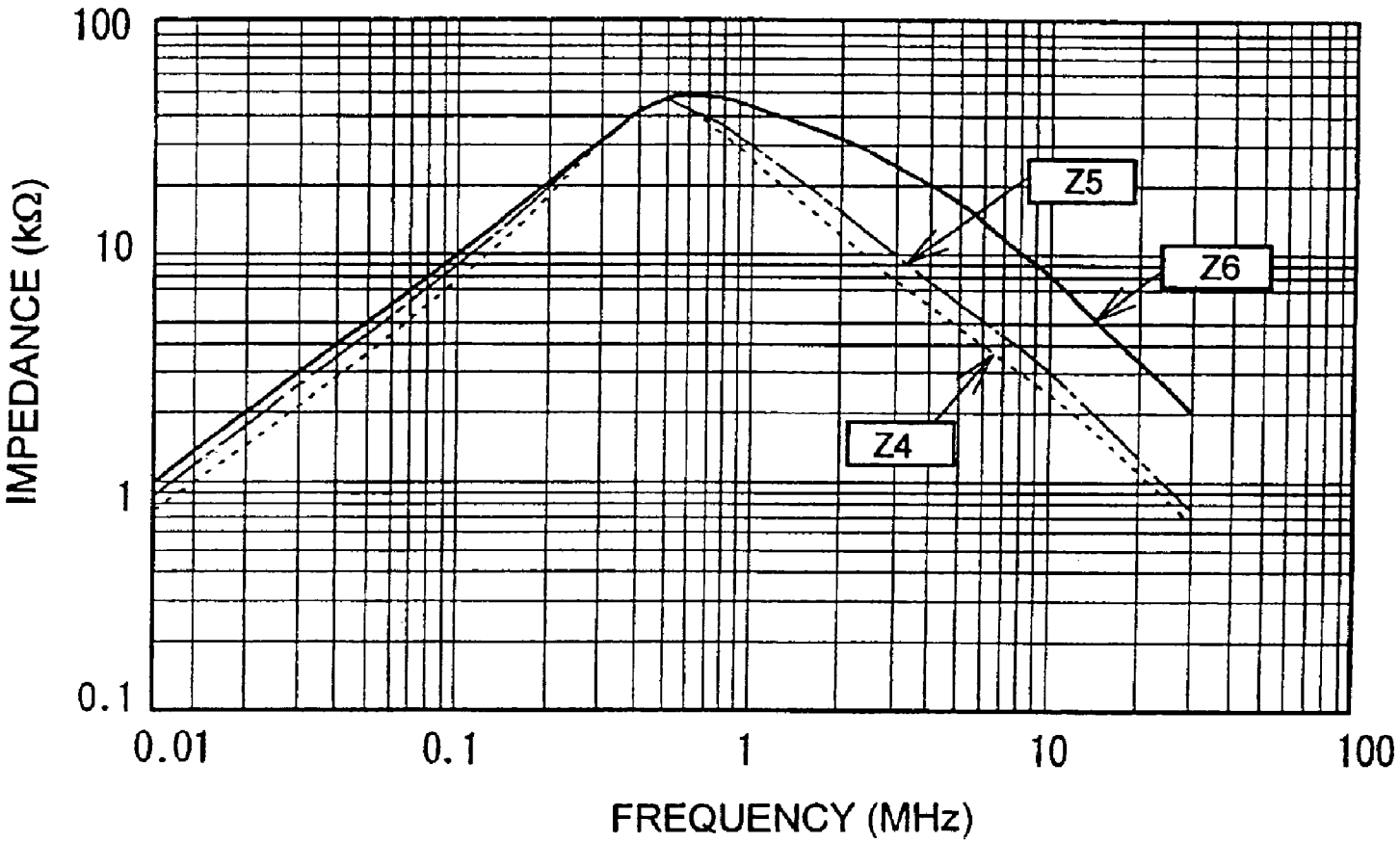
FIG. 2 shows frequency characteristics of impedance of the common mode choke coil of the present invention.
Figure 10:
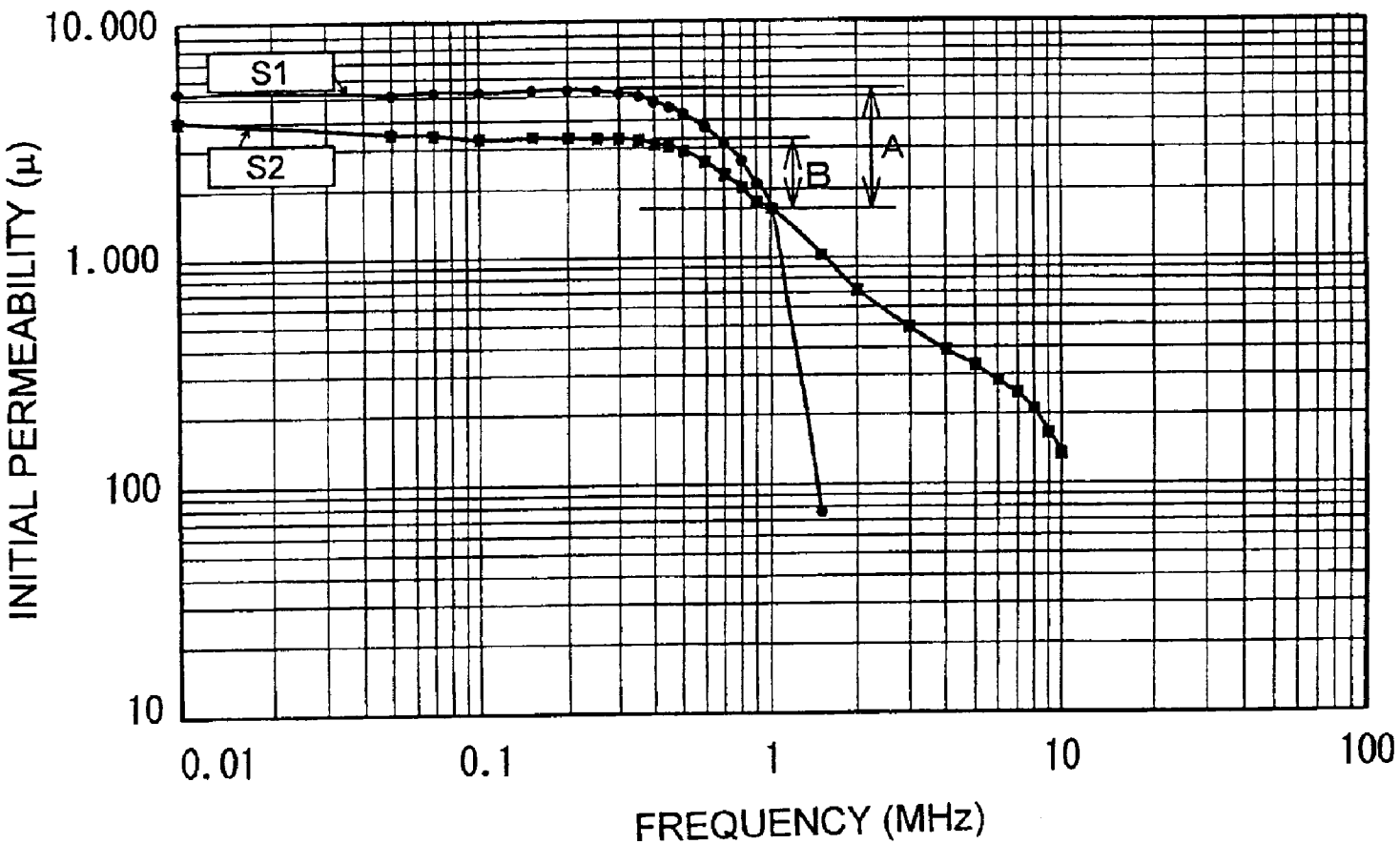
FIG. 10 shows frequency characteristics of initial permeability of conventional and new ferrite cores.

Frequency characteristics of the common mode choke coil 1 of the present invention are shown by symbol Z6 in FIG. 2. The common mode choke coil 1 uses the above described new Mn—Zn ferrite core with edgewise windings of a rectangular wire, and one winding thereof has an inductance of 8 mH. The magnetic core 5 of the common choke coil 1 having the frequency characteristics shown by symbol Z6 in FIG. 2 is of the new Mn—Zn ferrite core having a height of 18 mm, a width of 25 mm and a thickness of 8 mm, and has characteristics shown by S2 in FIG. 10. For comparison purpose, FIG. 2 also shows frequency characteristics (shown by symbol Z4) of the common mode choke coil of FIG. 4, which uses the conventional Mn—Zn ferrite core having characteristics shown by S1 in FIG. 10 and having a round insulated wire wound therearound, and another frequency characteristics (shown by symbol Z5) of the common mode choke coil of FIG. 4, which uses the new Mn—Zn ferrite core.

Figure 11:
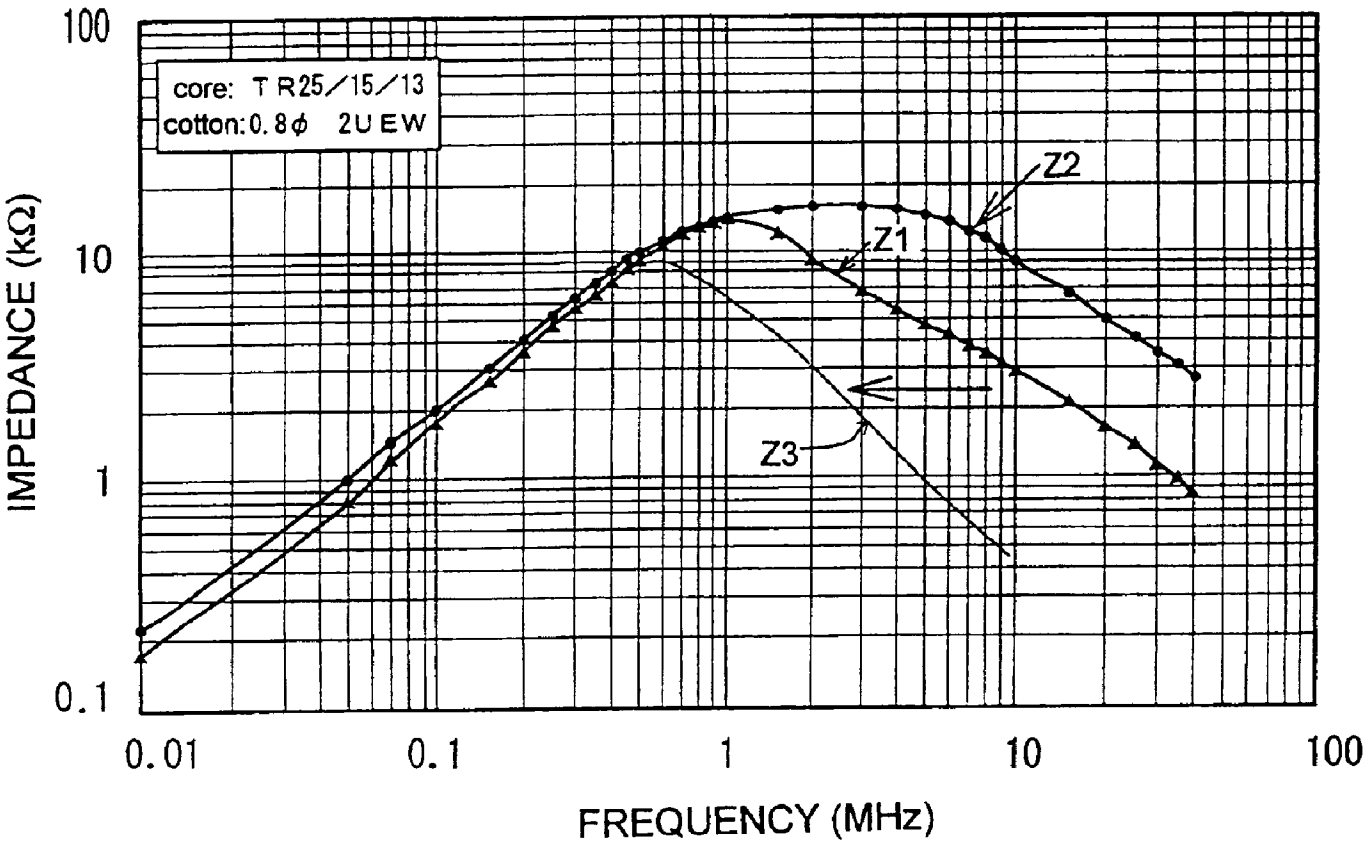
FIG. 11 shows frequency characteristics of impedance of three different ferrite cores.

The common mode choke coil (Z4), which uses the conventional Mn—Zn ferrite core with a round wire wound therearound, has an impedance of 45 k Ω at 500 kHz but has its impedance reduced to 2.2 kΩ at 10 MHz due to a decrease in the core initial permeability and an influence of the winding stray capacity. Also, the common mode choke coil (Z5), which uses the new Mn—Zn ferrite core with a round insulated wire wound therearound, has a good core initial permeability in the high frequency band and has an impedance of 45 kΩ at 500 kHz, but has its impedance reduced to 2.8 kΩ at 10 MHz due to an influence of the winding stray capacity as discussed in FIG. 11. On the other hand, the common mode choke coil 1 (Z6) of the present invention has a good core initial permeability in the high frequency band and a small winding stray capacity, and therefore can fully utilize excellent core characteristics without the influence of the stray capacity as discussed in FIG. 11, which results in an increased maximum value of the impedance, achieving 48 kΩ at 700 kHz, and 7.3 kΩ at 10 MHz.

That is to say, in the common mode choke coil (Z4) the impedance value at 10 MHz is reduced to 1/20 of its maximum value, and on the other hand, in the common mode choke coil 1 (Z6) of the present invention the impedance value at 10 MHz is reduced to only 1/6.5 of its maximum value, which shows the common mode choke coil 1 of the present invention using the new Mn—Zn ferrite core with edgewise windings of a rectangular wire is superior. In other words, for impedance reduced to a same value, if the common mode choke coil (Z4) can be used up to 10 MHz, the common mode choke coil 1 (Z6) of the present invention can be used up to 30 MHz.

A preferred embodiment of a line filter using common mode choke coils according to the present invention will hereinafter be explained with reference to FIG. 3 and also FIGS. 7 and 8.

Figure 7:
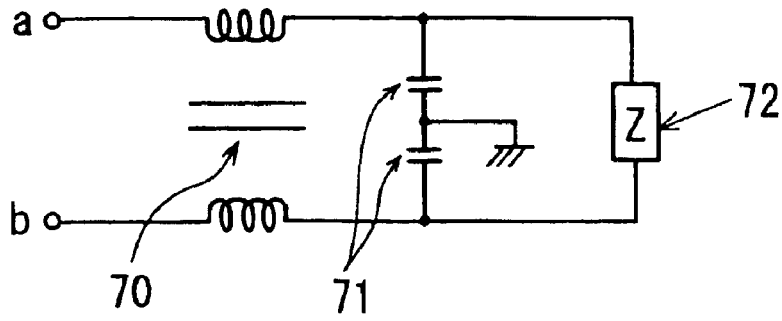
FIG. 7 PRIOR ART
FIG. 7 shows a circuit diagram of a conventional line filter using a conventional common mode choke coil.
Figure 8:
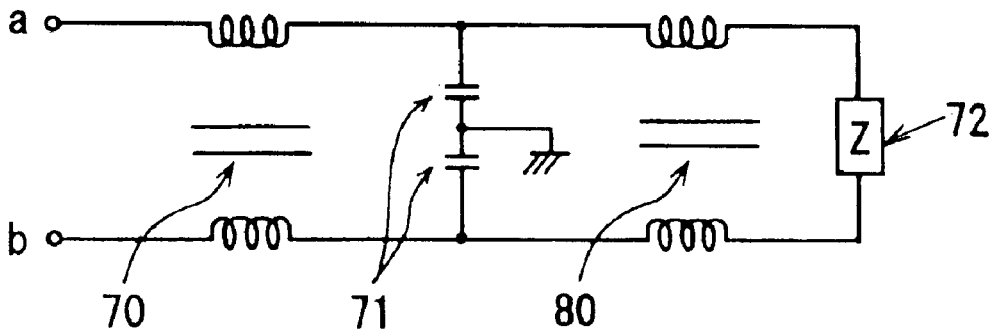
FIG. 8 PRIOR ART
FIG. 8 shows a circuit diagram of another conventional line filter using two common mode choke coils.
Figure 9:
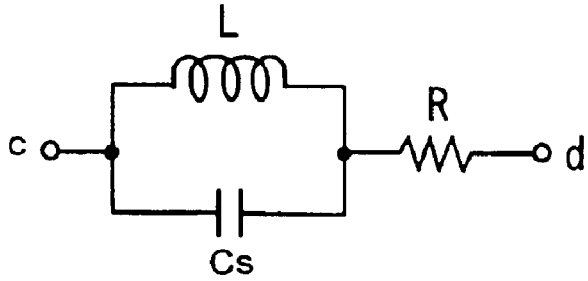
FIG. 9 shows an equivalent circuit of one winding of a common mode choke coil.

Referring to FIGS. 7 and 8, a conventional line filter comprises a common mode choke coil 70 and two by-pass capacitors 71 such that one termination of the common mode choke coil 70 serves an input terminal, the other termination thereof is connected to the by-pass capacitors 71 and serves as an output terminal, and that a load 72 is connected to both ends of the output terminal. Thus, deterioration of inductance performance in the high frequency band is made up for by the by-pass capacitors 71, a high frequency noise current is caused to flow toward the ground, and noises are removed.

Figure 3:
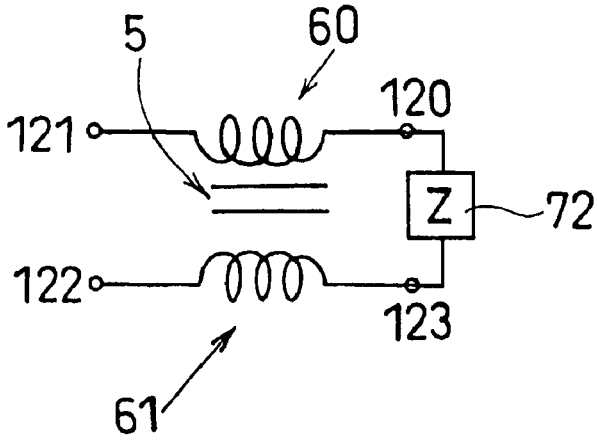
FIG. 3 shows a circuit diagram of a line filter using the common mode choke coil of the present invention.

On the other hand, as shown in FIG. 3, the line filter of the present invention uses a common mode choke coil which comprises first and second edgewise windings 60 and 61 respectively having first and second rectangular insulated wires. The first winding 60 is provided around a core leg of the new Mn—Zn ferrite core 5 shaped square and forming a closed magnetic path, and the second winding 61 is provided around a core leg of the new Mn—Zn magnetic core opposite to the magnetic leg having the first winding 60 provided therearound. One terminations 121 and 122 of the first and second windings 60 and 61, respectively, serve as input terminals, and the other terminations 120 and 123 of the first and second windings 60 and 61, respectively, serve as output terminals. The first and second windings 60 and 61 are wound such that respective magnetic fluxes generated by the first and second windings 60 and 61 cancel out each other when a line current is applied to the aforementioned input terminals. Here, by-pass capacitors are not provided to be connected to the output terminals of the first and second windings 60 and 61. This is because the line filter using the new Mn—Zn ferrite core 5 suffers less deterioration in inductance performance in the high frequency band than the conventional common mode choke coil and also the first and second windings 60 and 61 have a rectangular wire wound edgewise and therefore have a small stray capacity, whereby by-pass capacitors are not required for causing high frequency noise current to flow toward the ground thereby to cut noises.

Figure 4:
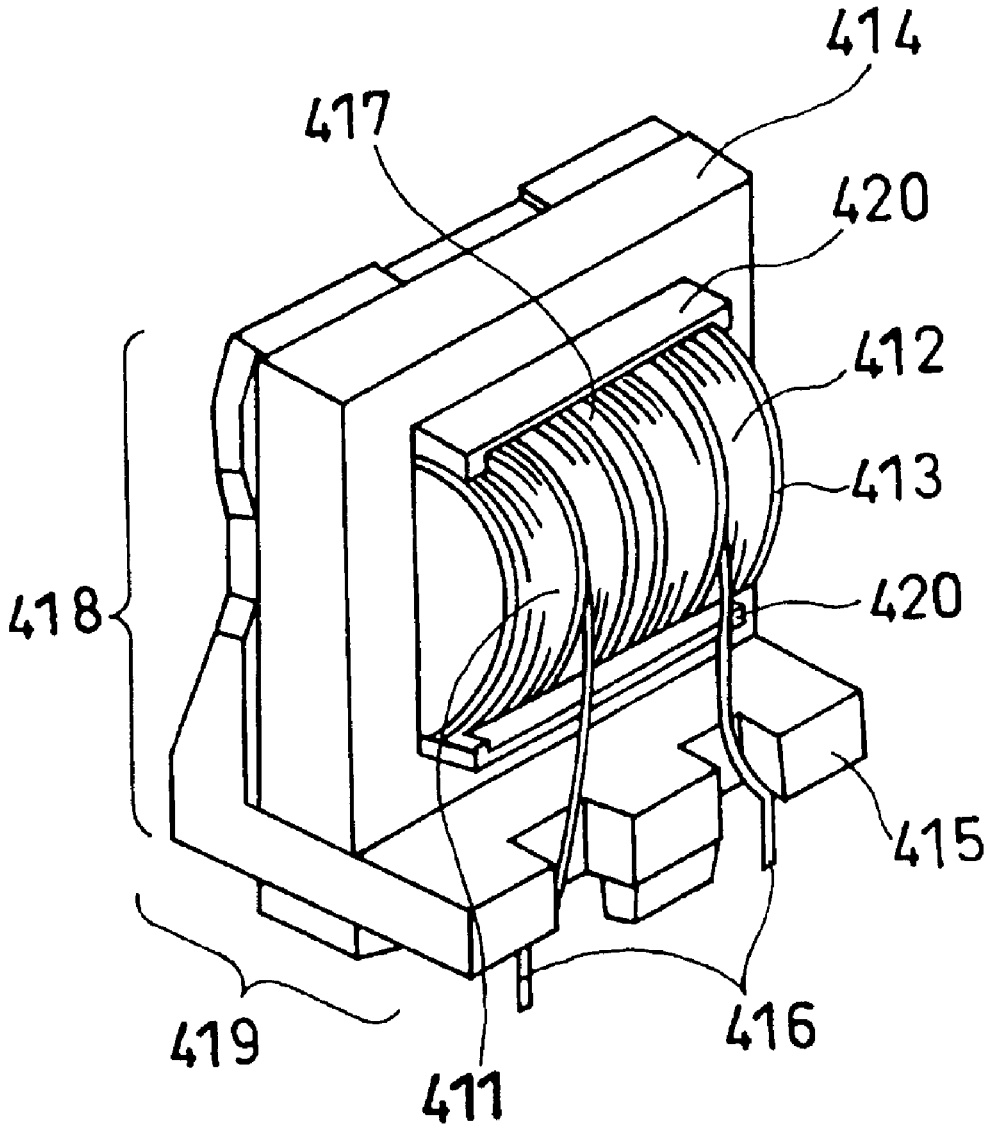
FIG. 4 PRIOR ART
FIG. 4 shows a perspective view of a conventional common mode choke coil using a round insulated wire.
Figure 5B:
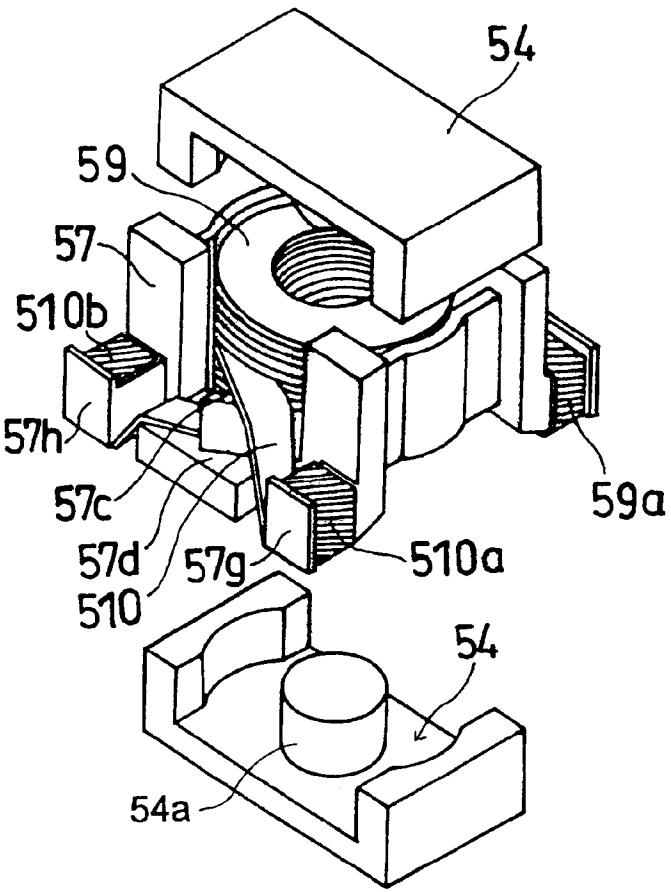
FIG. 5B PRIOR ART
FIGS. 5A and 5B show perspective views of a conventional common mode choke coil using edgewise windings, viewed from two opposing directions, respectively.
Figure 5A:
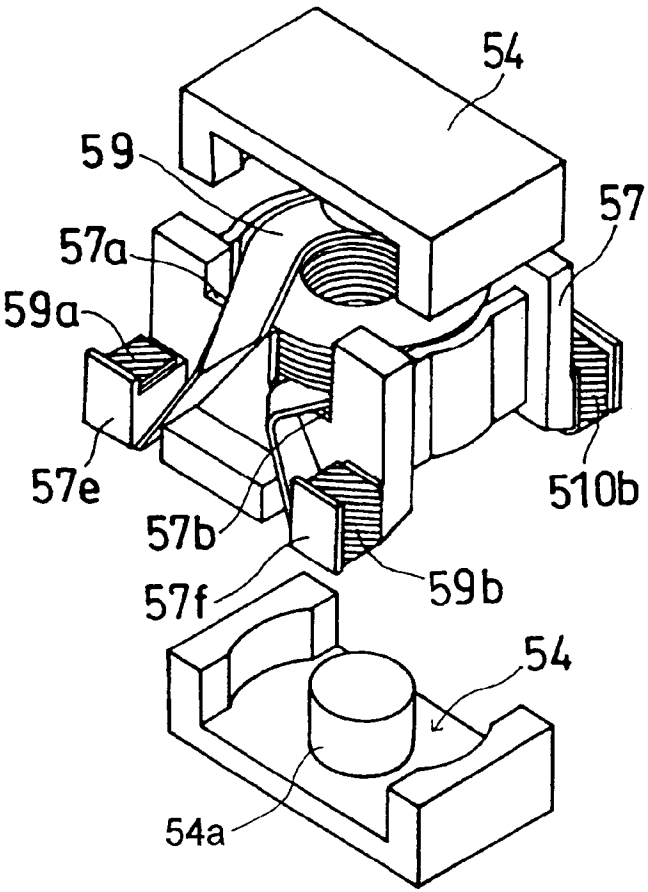
FIG. 5A PRIOR ART
Figure 6:
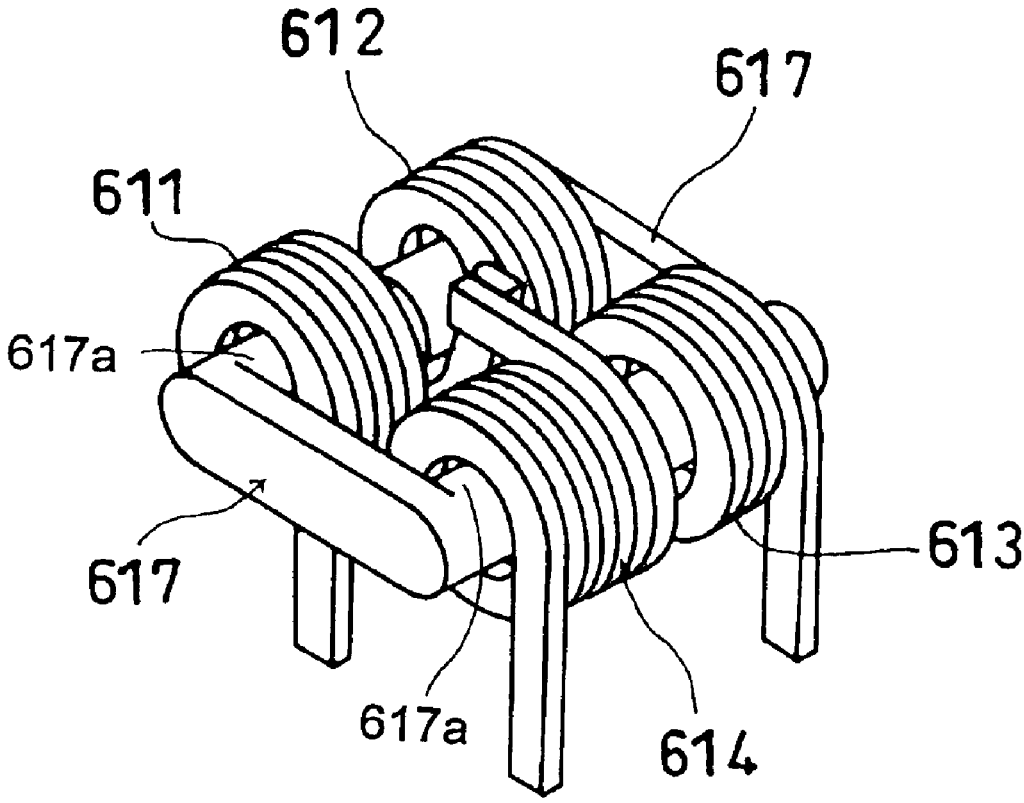
FIG. 6 PRIOR ART
FIG. 6 shows a perspective view of another conventional common mode choke coil using edgewise windings.

Also, since the winding factor is improved by using a rectangular wire and further by forming windings around the both core legs of the square-shaped magnetic core, the windings can gain a larger inductance in the low frequency band without suffering reduction in inductance in the high frequency band compared with the conventional windings of FIG. 4, and a plurality (two 70 and 80 in FIG. 8) of common mode choke coils employed to improve filter characteristics can be substituted by one common mode choke coil.

What is claimed is:

1. A common mode choke coil comprising:

a Mn—Zn ferrite core which is shaped square, forms a closed magnetic path, and which has an initial permeability of at least 3,000 at 100 kHz and at least 100 at 10 MHz at room temperature; and a first and second edgewise winding which is formed of a first rectangular insulated wire, and which is provided around a core leg of said Mn—Zn ferrite core; and second edgewise winding which is formed of second rectangular insulated wire, and which is provided around a core leg of said Mn—Zn ferrite core located oppositely to said core leg having said first edgewise winding provided therearound, said second edgewise winding being wired independent of said first edgewise winding.

2. A common mode choke coil as claimed in claim 1, wherein said Mn—Zn ferrite core has a main component composition comprising 44.0 to 49.8 mol % $Fe_2O_3$, 15.0 to 26.5 mol % ZnO, 0.1 to 3.0 mol % CoO, 0.02 to 1.00 mol % $Mn_2O_3$ and the remainder consisting of MnO, and also has a subsidiary component composition comprising at least one of 0.010 to 0.200 mass % $V_2O_5$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass % $WO_3$.

3. A common mode choke coil as claimed in claim 1, wherein said Mn—Zn ferrite core has a main component composition comprising 44.0 to 49.8 mol % $Fe_2O_3$, 15.0 to 26.5 mol % ZnO, 0.02 to 1.00 mol % $Mn_2O_3$ and the remainder consisting of MnO, and also has a subsidiary component composition comprising at least one of 0.010 to 0.200 mass % $V_2O_5$, 0.005 to 0.100 mass % $Bi_2O_3$, 0.005 to 0.100 mass % $In_2O_3$, 0.005 to 0.100 mass % PbO, 0.001 to 0.100 mass % $MoO_3$ and 0.001 to 0.100 mass% $WO_3$.

4. A line filter comprising:

a Mn—Zn ferrite core which is shaped square, forms a closed magnetic path, and which has an initial permeability of at least 3,000 at 100 kHz and at least 100 at 10 MHz at room temperature; and a first edgewise winding which is formed respectively of a first rectangular insulated wire, and which is provided around a core leg of said Mn—Zn ferrite core; and second edgewise winding which is formed of second rectangular insulated wire, and which is provided around a core leg of said Mn—Zn ferrite core located oppositely to said core leg having said first edgewise winding provided therearound, said second edgewise winding being wired independent of said first edgewise winding, wherein one terminations of said first and second edgewise windings are input terminals, the other terminations of said first and second edgewise windings are output terminals, and said first and second windings are connected to each other such that respective magnetic fluxes generated by said first and second edgewise windings cancel out each other when a line current is applied to said input terminals.

5. A common mode choke coil as claimed in claim 1, used in a line filter having no by-path capacitors.

6. A common mode choke coil as claimed in claim 2, used in a line filter having no by-path capacitors.

7. A common mode choke coil as claimed in claim 3, used in a line filter having no by-path capacitors.

8. A line filter as claimed in claim 4, wherein said line filter has no by-path capacitors.

9. A line filter as claimed in claim 4, wherein said line filter has one common mode choke coil.

* * * * *

UNITED STATES PATENT AND TRADEMARK OFFICE

CERTIFICATE OF CORRECTION

PATENT NO. : 6,917,273 B2
DATED : July 12, 2005
INVENTOR(S) : Toshinori Okamoto

It is certified that error appears in the above-identified patent and that said Letters Patent is hereby corrected as shown below:

Column 9,
Line 35, delete “and”;
Line 36, delete “and second”;
Lines 39 and 40, change “second rectangular insulated wire” to -- a second rectangular insulated wire --;

Column 10,
Line 20, delete “and”;
Line 21, delete “respectively”; and
Lines 24 and 25, change “second rectangular insulated wire” to -- a second rectangular insulated wire --.

Signed and Sealed this

Twentieth Day of December, 2005

JON W. DUDAS
*Director of the United States Patent and Trademark Office*